US007751954B2

(12) United States Patent
Matsuda et al.

(10) Patent No.: US 7,751,954 B2
(45) Date of Patent: Jul. 6, 2010

(54) OPERATING SYSTEM OF CONSTRUCTION MACHINERY

(75) Inventors: Mitsunori Matsuda, Hirakata (JP); Kouji Hoshi, Hirakata (JP)

(73) Assignee: Komatsu Ltd., Tokyo (JP)

( * ) Notice: Subject to any disclaimer, the term of this patent is extended or adjusted under 35 U.S.C. 154(b) by 1162 days.

(21) Appl. No.: 10/570,153

(22) PCT Filed: Sep. 1, 2004

(86) PCT No.: PCT/JP2004/012644

§ 371 (c)(1),
(2), (4) Date: Mar. 1, 2006

(87) PCT Pub. No.: WO2005/024145

PCT Pub. Date: Mar. 17, 2005

(65) Prior Publication Data

US 2008/0249679 A1 Oct. 9, 2008

(30) Foreign Application Priority Data

Sep. 2, 2003 (JP) ..... 2003-310366
Jul. 2, 2004 (JP) ..... 2004-196907

(51) Int. Cl.
*G01M 15/05* (2006.01)
*G06F 19/00* (2006.01)

(52) U.S. Cl. ..... 701/31; 701/1; 701/37; 701/50; 60/368; 60/427; 60/428; 60/431

(58) Field of Classification Search ..... 701/31, 701/1, 37, 50; 60/368, 427, 428, 431
See application file for complete search history.

(56) References Cited

U.S. PATENT DOCUMENTS 5,077,973 A * 1/1992 Suzuki et al. ..... 60/428

(Continued)

FOREIGN PATENT DOCUMENTS

JP 55-31669 3/1980

(Continued)

OTHER PUBLICATIONS

International Search Report of International Application PCT/JP2004/012644 mailed Dec. 28, 2004.

(Continued)

*Primary Examiner*—Khoi Tran
*Assistant Examiner*—Rodney King
(74) *Attorney, Agent, or Firm*—Westerman, Hattori, Daniels & Adrian, LLP

(57) ABSTRACT

The operating system for a construction machine gives advice on efficient operation to an operator. A specified state value relating to the operational condition of the construction machine, for example, the hydraulic oil pressure or engine speed, is detected (S101), and the frequency distribution of the state value in prescribed time intervals is calculated (S102). The variable range of the state value is classified into plural regions beforehand, and different target values are pre-set for each these regions. For each region, the frequency distribution is compared with the target value (S104, 106, 108, 110, 112), and as a result of the comparison, a applicable message is selected from the prescribed messages and output (S105, 107, 109, 111, 113). The output message may also be selected according to the combination of the comparison results for the plural state values such as the hydraulic oil pressure and engine speed.

15 Claims, 16 Drawing Sheets

8: ATTACHMENT PEDAL
9: SIDE WINDOW
10: INSTRUMENT PANEL
11: OPERATOR'S CABIN
13: OPERATOR'S SEAT
14: TRAVEL OPERATING SECTION
15:TRAVEL LEVER
16: TRAVEL LEVER
17: TRAVEL PEDAL
18: TRAVEL PEDAL
19: WORK TOOL OPERATING LEVER
20: WORK TOOL OPERATING LEVER
21: LOCK LEVER
22: MONITOR DEVICE
23: FRONT WINDOW
24: EXTERNAL CASE
25: VERTICAL FRAME
26: MONITOR SCREEN
27: PUSH BUTTON
30: DISPLAY SECTION

U.S. PATENT DOCUMENTS

| | | | | |
|---|---|---|---|---|
| 5,155,996 | A * | 10/1992 | Tatsumi et al. | 60/431 |
| 5,479,778 | A * | 1/1996 | Toyooka et al. | 60/431 |
| 5,722,911 | A * | 3/1998 | Ibaraki et al. | 477/3 |
| 5,745,159 | A * | 4/1998 | Wax et al. | 725/76 |
| 6,338,694 | B1 * | 1/2002 | Eguchi | 477/39 |
| 2002/0016232 | A1 * | 2/2002 | Amisano et al. | 477/77 |
| 2002/0150267 | A1 * | 10/2002 | Furuta | 381/110 |
| 2003/0020342 | A1 * | 1/2003 | Takeuchi | 310/68 B |
| 2003/0193406 | A1 * | 10/2003 | Kinugawa | 340/870.16 |
| 2003/0221845 | A1 * | 12/2003 | Takahashi | 172/3 |
| 2005/0027421 | A1 * | 2/2005 | Humpal et al. | 701/50 |
| 2005/0149244 | A1 * | 7/2005 | Matsuda | 701/50 |

FOREIGN PATENT DOCUMENTS

| | | | |
|---|---|---|---|
| JP | 2534880 | | 6/1996 |
| JP | 9-76850 | | 3/1997 |
| JP | 9-329051 | | 12/1997 |
| JP | 2001-11901 | | 1/2001 |
| KR | 2000-0011499 | A | 2/2000 |
| KR | 10-0271280 | B1 | 11/2000 |
| KR | 10-0378727 | B1 | 6/2003 |
| WO | 98/26132 | A1 | 6/1998 |

OTHER PUBLICATIONS

Office Action dated Apr. 27, 2009 issued in corresponding Korean Patent Application 10-2006-7003653.

* cited by examiner

8: ATTACHMENT PEDAL
9: SIDE WINDOW
10: INSTRUMENT PANEL
11: OPERATOR'S CABIN
13: OPERATOR'S SEAT
14: TRAVEL OPERATING SECTION
15:TRAVEL LEVER
16: TRAVEL LEVER
17: TRAVEL PEDAL
18: TRAVEL PEDAL
19: WORK TOOL OPERATING LEVER
20: WORK TOOL OPERATING LEVER
21: LOCK LEVER
22: MONITOR DEVICE
23: FRONT WINDOW
24: EXTERNAL CASE
25: VERTICAL FRAME
26: MONITOR SCREEN
27: PUSH BUTTON
30: DISPLAY SECTION

1: LOWER TRAVELING BODY
2: ROTATION MECHANISM
3: UPPER ROTATING BODY
4: WORK TOOL
5: BOOM
6: ARM
7: BUCKET
11: OPERATOR'S CAB

FIG. 10

| HYDRAULIC OIL PRESSURE REGION | EQUAL TO OR ABOVE ESTABLISHED VALUE? | ENGINE SPEED REGION | EQUAL TO OR ABOVE ESTABLISHED VALUE? | DISPLAY | |
|---|---|---|---|---|---|
| I | YES | III | YES | "LIGHT LOAD, FREQUENT WASTE" | T101 |
| | | | NO | NONE | T102 |
| | | IV | YES | "LIGHT LOAD, SUITABLE WORK" | T103 |
| | | | NO | NONE | T104 |
| | | V | YES | "LIGHT LOAD, HIGH ENGINE SPEED" | T105 |
| | | | NO | NONE | T106 |
| II | YES | III | YES | "HIGH LOAD, FREQUENT WASTE" | T107 |
| | | | NO | NONE | T108 |
| | | IV | YES | NONE | T109 |
| | | | NO | NONE | T110 |
| | | V | YES | "HIGH LOAD, HIGH ROTATION WORK FREQUENT" | T111 |
| | | | NO | NONE | T112 |

OPERATING SYSTEM OF CONSTRUCTION MACHINERY

TECHNICAL FIELD

The present invention relates to an operating system for a construction machine, such as an excavator, or the like.

BACKGROUND ART

Desirably, in a construction machine, such as an excavator, it is sought to save energy when the machine is traveling or performing various work tasks. Therefore, a conventional device is known, which calculates the quantity of work and the fuel consumption, and is able to analyze whether the work efficiency is good or poor (see, for example, Japanese Patent Publication No. 2534880 (pp. 3-4, FIG. 1)). Furthermore, a method is also known whereby an overall repair plan, update plan, and the like, for a self-propelled vehicle can be proposed by determining the engine status and work quantity (see, for example, Japanese Patent Laid-open No. 9-329051 (pp. 3-4, FIG. 2).

In other words, the construction machine disclosed in Japanese Patent Publication No. 2534880 (pp. 3-4, FIG. 1) determines the work quantity by means of a detection device comprising an angle speed sensor, a fuel sensor, a weight detection sensor, and the like, calculates the work quantity and fuel consumption during the cycle time, and calculates the quantity of work per unit time and the quantity of work per unit of fuel consumption. The construction machine prints out the quantity of work per unit time and the quantity of work per unit of fuel consumption thus calculated. Furthermore, the construction machine (self-propelled vehicle) disclosed in Japanese Patent Laid-open No. 9-329051 (pp. 3-4, FIG. 2) comprises: engine speed detecting means; fuel injection amount per engine revolution detecting means; loaded weight detecting means; vehicle speed detecting means; and oscillating means for issuing a trigger signal at prescribed time intervals; and the like. It calculates the fuel injection amount per unit time, the transported quantity per unit of fuel injection amount, and the like.

DISCLOSURE OF THE INVENTION

In this way, in the construction machine disclosed in Japanese Patent Publication No. 2534880 (pp. 3-4, FIG. 1), the quantity of work per unit time, the quantity of work per unit of fuel consumption, and the like, are merely disclosed (displayed) in a report document. Therefore, the operator is not able to operate the machine in a way which improves fuel consumption, even if he or she sees this report, and therefore, this does not permit the operator to perform highly efficient driving and work, during driving and work tasks. Furthermore, in the construction machine (self-propelled vehicle) disclosed in Japanese Patent Laid-open No. 9-329051, a repair plan, update plan, and the like, are proposed on the basis of the fuel injection amount per unit time, the transported quantity per unit fuel injection amount, and the like, and this machine also fails to aid the operator in performing highly efficient operation.

The invention was devised in order to resolve the problems of the prior art, an object thereof being to provide an operation system for a construction machine whereby the operator is able to receive advice in order to perform efficient operation and control in accordance with the work contents, and to operate and control the machine in a manner which improves fuel consumption, and the like.

The operating system for a construction machine according to the present invention comprises: setting means for setting a target value with respect to a frequency distribution of a prescribed state value relating to an operational condition of the construction machine; detecting means for detecting a prescribed state value; and control means for calculating the frequency distribution of said prescribed state value detected by said detecting means, comparing said frequency distribution thus calculated with said target value set by said setting means, and outputting a previously prepared message in accordance with the comparison result.

Furthermore, this operating system may also be composed in such a manner that a plurality of regions are set in the range of possible variation of said prescribed state value; the setting means sets a target value for each region; and the control means compares the frequency distribution and target value for each region and outputs a message corresponding to the comparison result for each region.

Furthermore, this operating system may also be composed in such a manner that the setting means sets target values for a plurality of prescribed state values; and the detecting means detects a plurality of prescribed state values; and the control means calculates a plurality of frequency distributions of the plurality of prescribed state values, compares the frequency distribution with the target value for each of the prescribed state values, and outputs a previously prepared message in accordance with the combination of comparison results for the plurality of prescribed state values.

For the prescribed state value of the operating system for a construction machine, it is possible to use, for example, the hydraulic oil pressure, the engine speed, or the frequency of a work action.

As the frequency of a work action, if the construction machine is an excavator, for example, it is possible to use a boom swinging operation, an arm swinging operation, a bucket swinging operation, a rotating operation of the upper rotating body, a travel operation, or the like. Therefore, supposing that the rotating operation has high frequency, it is possible to display a message in order that the operator reduces the angle of rotation of the machine. Furthermore, if the travel frequency is high (if the frequency of the travel time is high), then this indicates that wasteful movement in the worksite occurs frequently, and therefore a message can be displayed recommending the operator to avoid unnecessary movement in the worksite.

Furthermore, for the prescribed state value, it is possible to use the fuel consumption amount or the fuel consumption rate, for example.

The operating system for a construction machine may be composed in such a manner that a message is displayed on the monitor screen of the operator's cab. Furthermore, by outputting this message as a voice announcement, it is possible to achieve a composition in which the operator located in the operator's cab is able to identify the message, simply, without looking at the monitor screen, or the like.

The operating system for a construction machine can be composed in such a manner that the whole system is mounted in the construction machine. Thereby, it is possible to carry out processing for detecting the frequency distribution of the prescribed state value, outputting a message on the basis of the comparison between the calculated frequency and the target value, and the like, rapidly. Furthermore, there is no need to provide communications means in the machine and in a section located outside the machine.

Furthermore, the operating system may comprise an component located in the operating system, and another component located outside the operating system, in such a manner that a message is transmitted from the component outside the operating system to the component in the operating system. By this means, it is possible to reduce the amount of equipment constituting the system that is mounted in the operating system, and hence reductions in the weight and size of the operating system can be achieved. Since a message is sent to the operating system from a section outside the operating system, it is possible to set the timing at which this message is sent to the operating system, to a desirable timing, and the contents of the information thus transmitted can be changed as desired.

Furthermore, a message may also be displayed in the section outside the construction machine. In this case, it is possible for an externally located work manager, or the like, to identify the message.

The operating system according to a further aspect of the present invention comprises: setting means for setting a target value with respect to a frequency of a workless state of the construction machine; detecting means for detecting a workless state during the period that the engine is operated; control means for comparing the frequency detected by said detecting means with said target value set by said setting means, and outputting a previously prepared message in accordance with the comparison result.

Moreover, as a workless state, it is possible to use, for example, a state where an automatic deceleration function or a lever lock function is engaged.

The operation control method according to a further aspect of the present invention comprises the steps of: setting a target value corresponding to the frequency distribution of a prescribed state value relating to the operational condition of the construction machine; detecting the prescribed state value; and calculating the frequency distribution of said prescribed state value detected by said detecting means, comparing said frequency distribution thus calculated with said target value set by said setting means, and outputting a previously prepared message in accordance with the comparison result.

According to the operating system for a construction machine described above, the operator is able to receive a message corresponding to the result of a comparison between the frequency of a state value generated on the basis of the operation and control of the machine hitherto, and a target value that has been determined previously. Therefore, if the operator improves his or her subsequent operation of the machine on the basis of this message, the operator is able to perform efficient operation in accordance with a target value.

BRIEF DESCRIPTION OF THE DRAWINGS

FIG. 10 is a diagram showing an example of judgment rules and display messages based on a combination of a plurality of state values;

BEST MODE FOR CARRYING OUT THE INVENTION

Figure 2:
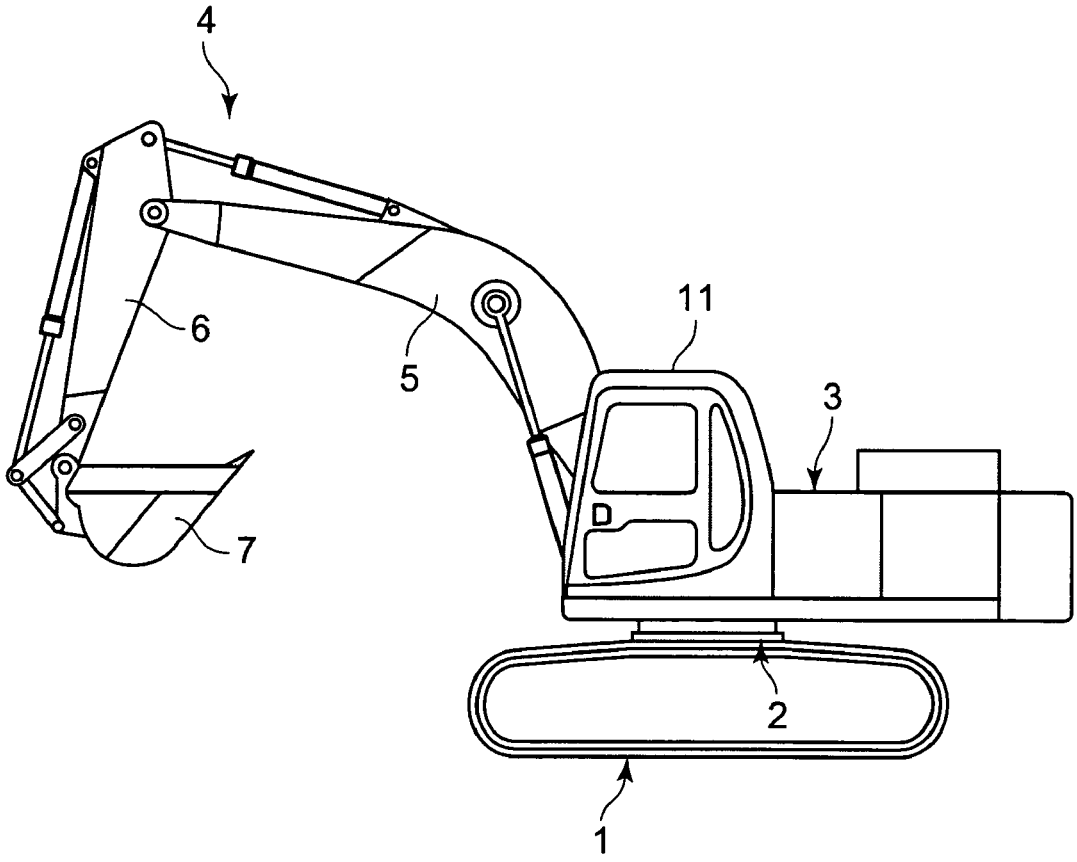
FIG. 2 is a general simplified diagram of the construction machine.

Next, a specific embodiment of the operating system of a construction machine according to this invention is described in detail with reference to the drawings. FIG. 2 is a simplified diagram of a construction machine fitted with this operating system. This construction machine is an excavator, which comprises a lower traveling body 1, and an upper rotating body 3 fitted rotatably via a rotation mechanism 2, on the upper part of the lower traveling body 1. A work tool 4 is coupled to the upper rotating body 3. This work tool 4 comprises a boom 5, of which the base part is coupled swingably to the upper rotating body 3, an arm 6 coupled swingably to the front end of the boom 5, and a bucket 7 coupled swingably to the front end of the arm 6. Furthermore, the upper rotating body 3 comprises an operator's cab 11, and the like.

Figure 1:
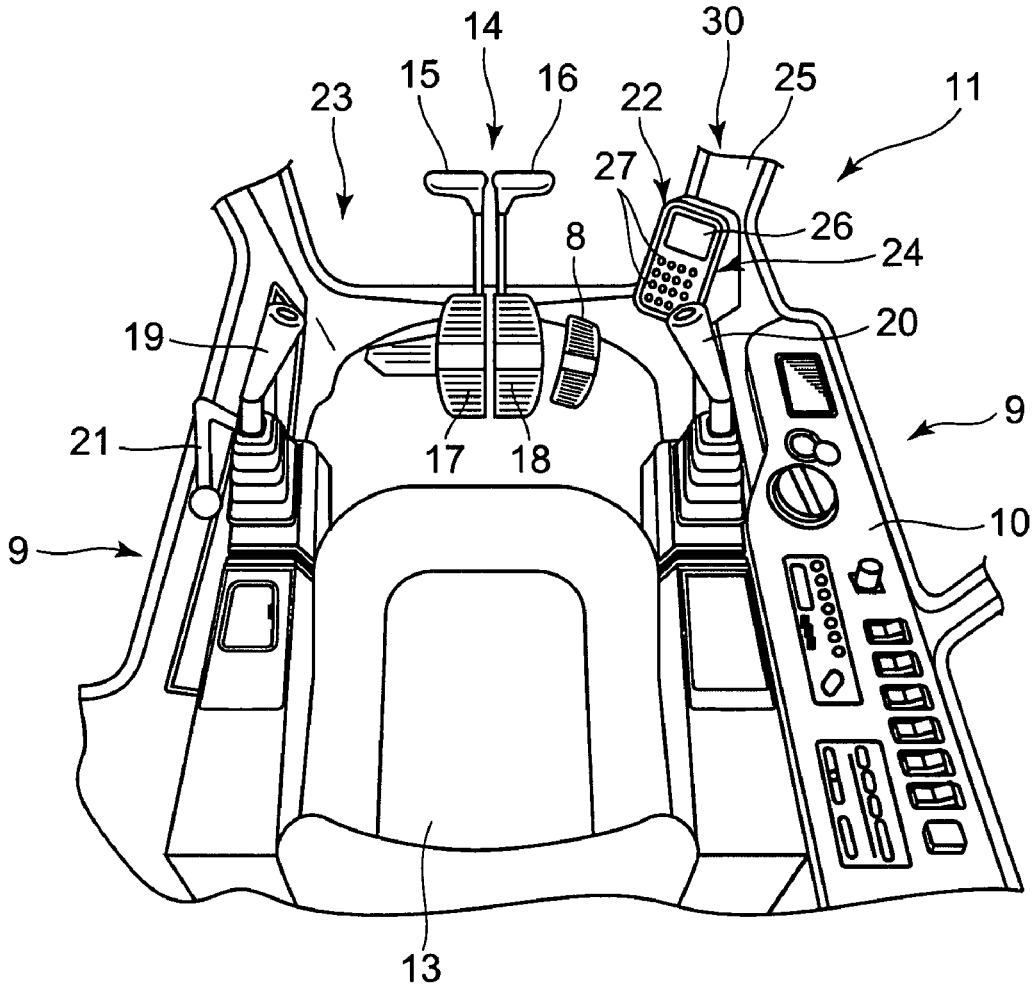
FIG. 1 is a principal perspective diagram showing an embodiment of a construction machine equipped with an operating system according to the present invention.

As shown in FIG. 1, an operator's seat 13 is provided in the center of the operator's cab 11 of the upper rotating body 3, and travel control section 14 is provided in front of the operator's seat 13. This travel control section 14 comprises travel levers 15 and 16, and travel pedals 17 and 18, which swing in unison with the respective travel levers 15 and 16. In this case, when the travel levers 15 and 16 are pushed forward, the lower traveling body 1 advances and when the travel levers 15 and 16 are pulled backward, the lower traveling body 1 reverses. An attachment pedal 8 is provided in the vicinity of the travel control section 14, and a meter panel 10 is provided on one of the side windows 9.

Furthermore, work tool operating levers 19 and 20 are provided respectively on the side portions of the operator's seat 13. These work tool operating levers 19 and 20 are used to perform upward and downward movement of the boom 5 and rotation of the arm 6 and bucket 7, as well as controlling the rotation of the upper rotating body 3 itself. Furthermore, a lock lever 21 is provided in the vicinity of one of the work tool operating levers 19. Here, the lock lever 21 serves to halt functions such as the operation of the work tool 4, the rotation of the upper rotating body 3, or the travel of the lower traveling body 1. In other words, it is possible to lock the movement of the work tool 4, and the like, by performing an upward pulling operation of the lock lever 21, and in this state, it will not be possible to move the work tool 4, and the like, even if the work tool operating levers 19, 20, and the like, are operated.

Furthermore, a monitor device 22 for displaying the engine status, and the like, is provided in the operator's cab 11 of the construction machine. Here, the engine status means, for example, the temperature of the engine cooling water, the temperature of engine oil, the amount of remaining fuel, and the like. The monitor device 22 is disposed below a vertical frame 25 which divides the front window 23 of the operator's cab 11 from one of the side windows 9, and a monitor screen 26 and operational push buttons 27, . . . are provided on the front surface of the external case 24 thereof. The monitor screen 26 is constituted by a liquid crystal panel, for example.

Figure 3:
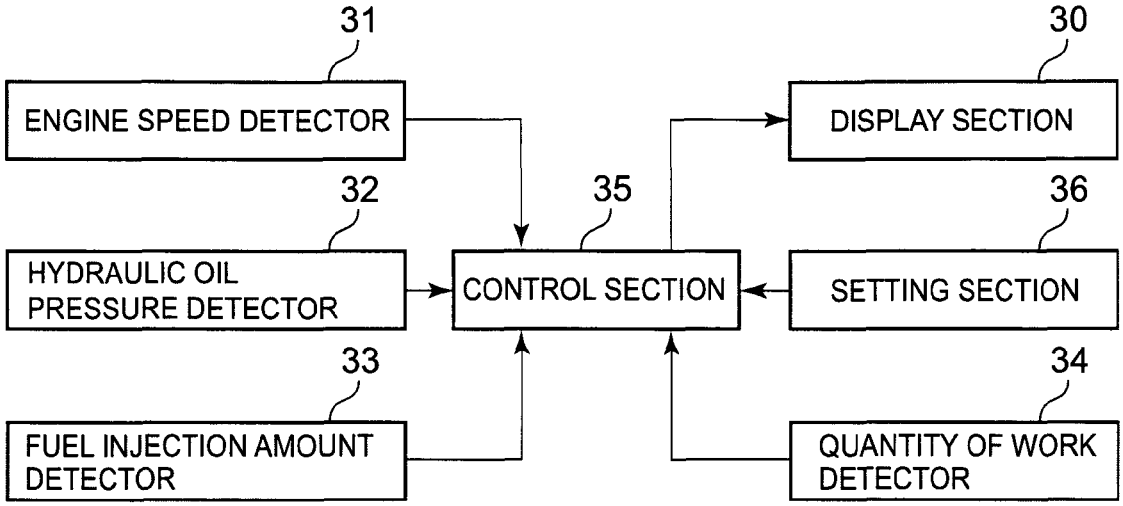
FIG. 3 is a simplified block diagram showing a control circuit of the aforementioned operating system.

The construction machine comprises a control circuit which constitutes an operating system as shown in FIG. 3. This circuit determines the frequency distribution of prescribed state values relating to the operational state of the construction machine within a prescribed period of time, compares this frequency distribution with a target value at which the frequency of the aforementioned prescribed state value indicates efficient operation, and if the frequency distribution lies outside the target value, then it is assumed that the operation is inefficient, and operational advice can be provided to the operator in order that the frequency distribution is brought within the target values. The control circuit comprises an engine speed detector 31, a hydraulic oil pressure detector 32, a fuel injection amount detector 33, a quantity of work detector 34, control section 35 to which detection values (data) from these detectors 31, 32, 33 and 34 are input, setting section 36 for setting the target value, and the like. Furthermore, the operational advice is displayed on the monitor screen 26 of the monitor device 22. It is possible to calculate the fuel consumption amount of the construction machine on the basis of the fuel injection amount calculated by the fuel injection amount detector 33. The quantity of work detector 34 consists of a sensor which detects the loaded weight of the bucket, for example, and the quantity of work during loading can be determined, for example, from (loaded amount×number of loads/time), or the like, by detecting the loaded amount in the bucket by means of a monitoring camera, or the like, and the quantity of work during transportation can be determined from (loaded weight×distance). For this purpose, the quantity of work detected by the quantity of work detector 34 is input to the control section (calculation section) 35, and here, the fuel consumption amount per quantity of work is calculated, for example. When detecting the quantity of work, it is also possible to detect the amount loaded in the bucket by means of visual observation by the operator, or the like, rather than using a sensor. Furthermore, the number of loads may be counted by means of a manually operated switch, or the like. The section which processes information, such as the control section 35, the setting section 36, and the like, may be realized by using a computer installed with a computer program for information processing, or alternatively, it may be realized by using a wired hardware circuit or a combination of a wired hardware circuit and a computer.

Examples of the state values relating to the operational condition of the construction machine include the hydraulic oil pressure, the engine speed, and the like. Below, an example of the control implemented in order to display a message, according to each type of state value, will be described.

Figure 4:
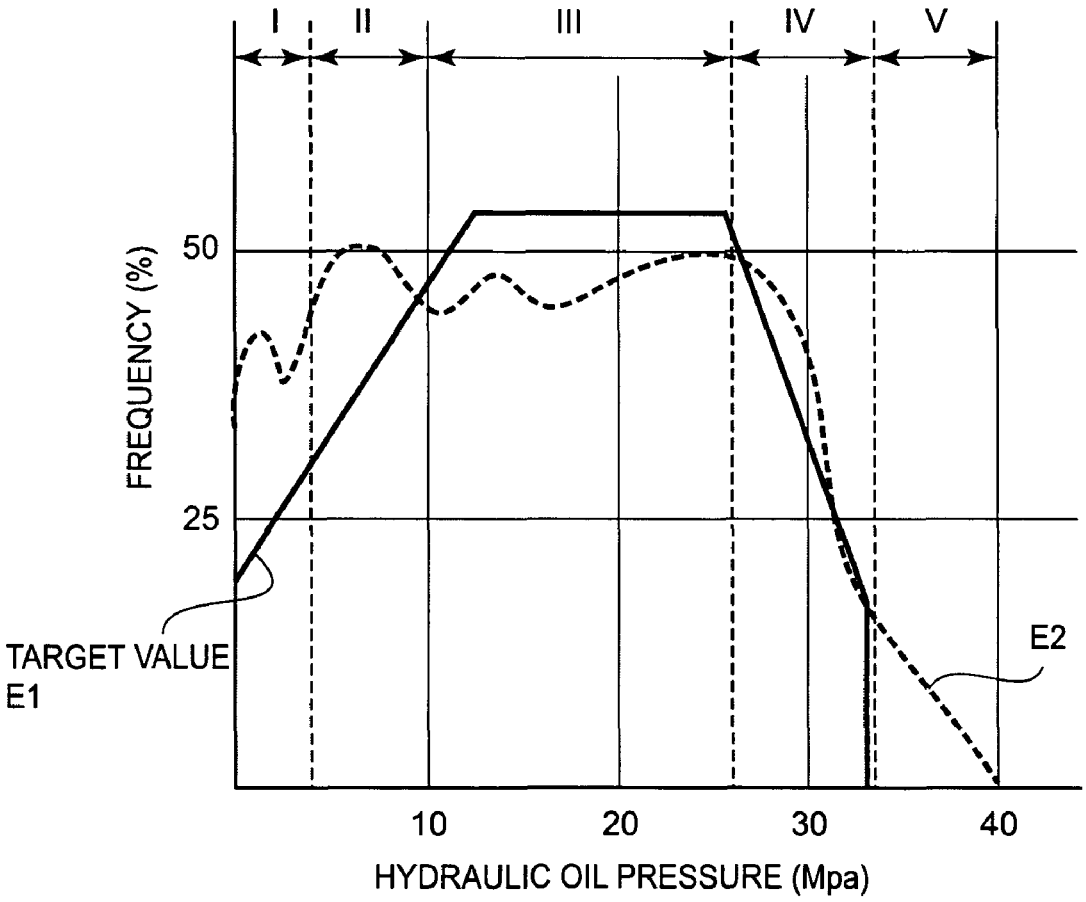
FIG. 4 is a diagram showing the hydraulic oil pressure distribution per unit time.

Firstly, an example of control in a case where the state value is the hydraulic oil pressure will be presented. FIG. 4 is a graph of the hydraulic oil pressure distribution per unit time.

As shown in FIG. 4, the control section 35 sets the region I, the region II, the region III, the region IV and the region V, within the range of variation of the hydraulic oil pressure. Region I is a region where it is inferred that the machine is operating without any load. Loadless operation is similar to "idling", and means a state where the engine is running but the construction machine is performing no substantial work at all. Region II is a region where it is inferred that the machine is performing wasteful work. Region III is a region where it is inferred that the construction machine is performing suitable work. Region IV is a region where it is inferred that the construction machine is performing high-load work. Region V is a region where it is inferred that the hydraulic oil pressure relief mechanism operates due to excessively high hydraulic oil pressure.

The setting section 36 sets a different target value E1 for each of the regions I to V, in accordance with instructions from the user, and these target values E1 are stored in the control section 35. The hydraulic oil pressure is detected within a prescribed time period by means of the hydraulic oil pressure detector 32, and the frequency distribution E2 of the hydraulic oil pressure thus detected is calculated by the control section 35 and stored in the control section 35. The control section 35 compares the previously determined target value E1 with the detected and calculated hydraulic oil pressure frequency distribution E2, and if the frequency distribution E2 exceeds the target value E1, then the construction machine is judged to be operating inefficiently, and a message is displayed on the monitor screen 26 prompting the operator to control the machine in such a manner that the frequency distribution E2 comes within the target value E1. The target value E1 is the upper limit of the range within which it is inferred that the machine is operating efficiently, and the range equal to and below this target value E1 is a target value range in which it is provisionally inferred that the machine is operating efficiently. Furthermore, the message displayed is previously determined by the setting section 36, and different message contents are previously stored in the control section 35 for each region.

Figure 5:
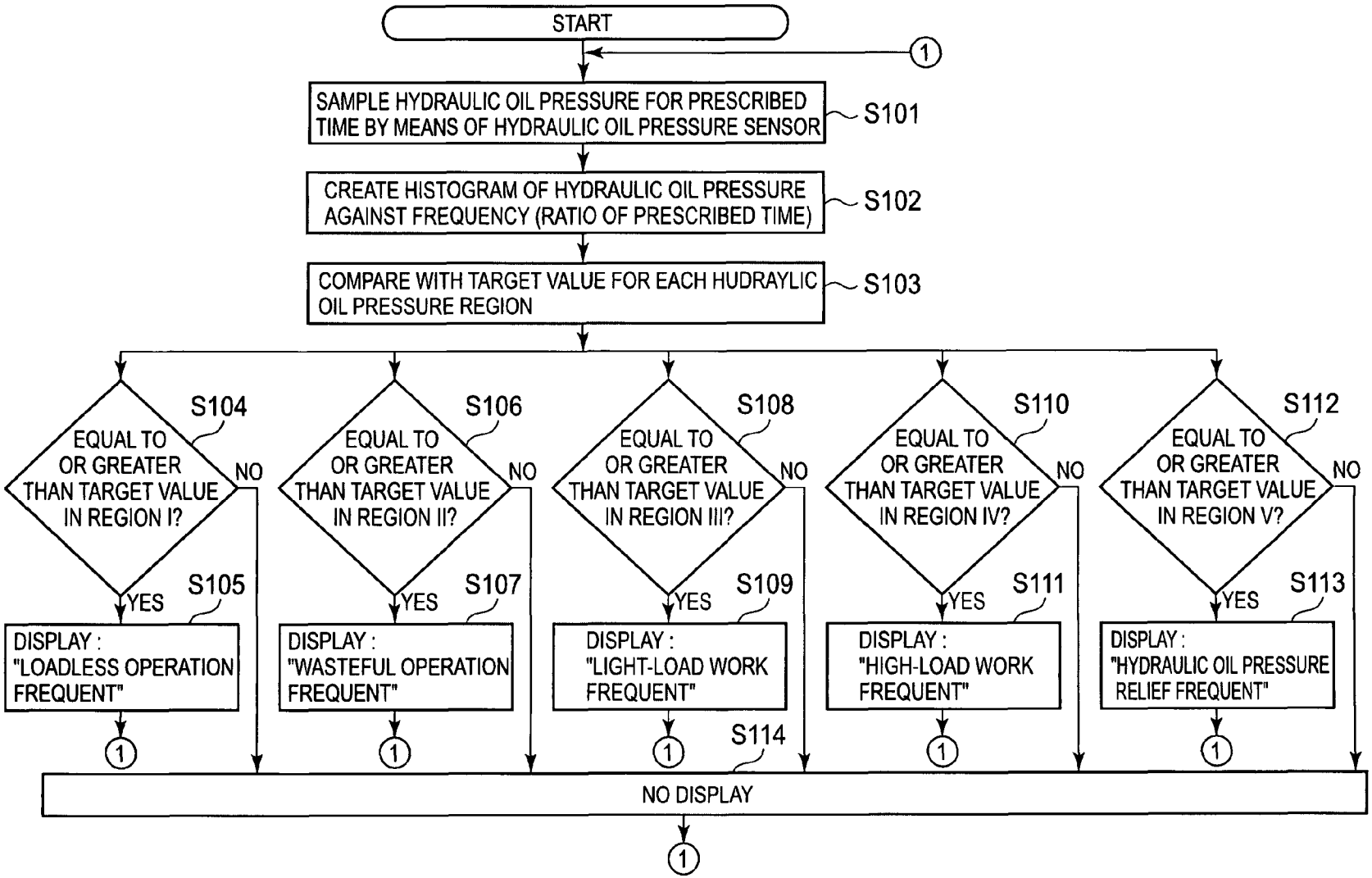
FIG. 5 is a flow diagram of a control example where the prescribed state value is the hydraulic oil pressure.

FIG. 5 shows the sequence of control for displaying a message in accordance with the result of comparing the frequency distribution E2 and the target value E1, and it is illustrated in the form of a flowchart.

As shown in FIG. 5, the control section 35 samples the hydraulic oil pressure value detected by the hydraulic oil pressure detector 32, over a prescribed time period designated by the user (S101). The control section 35 then creates a hydraulic oil pressure frequency distribution E2 on the basis of the sampled hydraulic oil pressure values (S102). Therefore, for each region preset by the setting section 36, the frequency distribution E2 is compared with the target value E1 preset by the setting section 36 (S103). Consequently, if the frequency distribution E2 exceeds the target value E1 in any one of the hydraulic oil pressure regions I, II, III, IV or V, then the construction machine is taken to be operating inefficiently and the control section 35 displays a message containing operational advice which has been prepared previously for the hydraulic oil pressure region in question (S104-S113).

At step 104, the extent of loadless operation is judged by performing the aforementioned comparison with respect to region I. At step 104, if the frequency distribution E2 has exceeded the target value E1, as in FIG. 4, then this indicates that the frequency of loadless operation is high and the operation of the machine is inefficient. Consequently, a preset message drawing attention to the inefficient operation of the machine is displayed (S105). On the other hand, if the frequency is equal to or less than the target value, then no message is displayed (S114). At step 106, the frequency of wasteful operation is judged by performing the aforementioned comparison with respect to region II. Similarly to FIG. 4, if the frequency distribution E2 has exceeded the target value E1, then this indicates that the frequency of wasteful work is high and the operation of the machine is inefficient.

Consequently, a preset message drawing attention to the inefficient operation of the machine is displayed (S107). On the other hand, if the frequency is equal to or less than the target value, then no message is displayed (S114). At step 108, the frequency of light-load operation is judged by performing the aforementioned comparison with respect to region III. At step 108, if the frequency distribution E2 has exceeded the target value E1, as in FIG. 4, then this indicates that the frequency of light-load work is high and the operation of the machine is inefficient. Consequently, a preset message drawing attention to the inefficient operation of the machine is displayed (S109). On the other hand, if the frequency is equal to or less than the target value, as shown in FIG. 4, then this indicates that the machine is operating efficiently, and hence no message is displayed (S114). At step 110, the frequency of high-load work is judged by performing the aforementioned comparison with respect to region IV. Similarly to FIG. 4, if the frequency distribution E2 has exceeded the target value E1, then this indicates that the operation of the machine is inefficient. Consequently, a preset message drawing attention to the inefficient operation of the machine is displayed (S111). On the other hand, if the frequency is equal to or less than the target value, then no message is displayed (S114). At step 112, the frequency of a hydraulic oil pressure relief action is judged by performing the aforementioned comparison with respect to region V. If the frequency distribution E2 exceeds the target value E1, then this indicates that the hydraulic oil pressure relief mechanism operates with high frequency, and consequently it is judged that the machine is operating inefficiently, and a preset message drawing attention to the inefficient operation of the machine is displayed (S113). On the other hand, if the frequency is equal to or less than the target value, then no message is displayed (S114).

Figure 6:
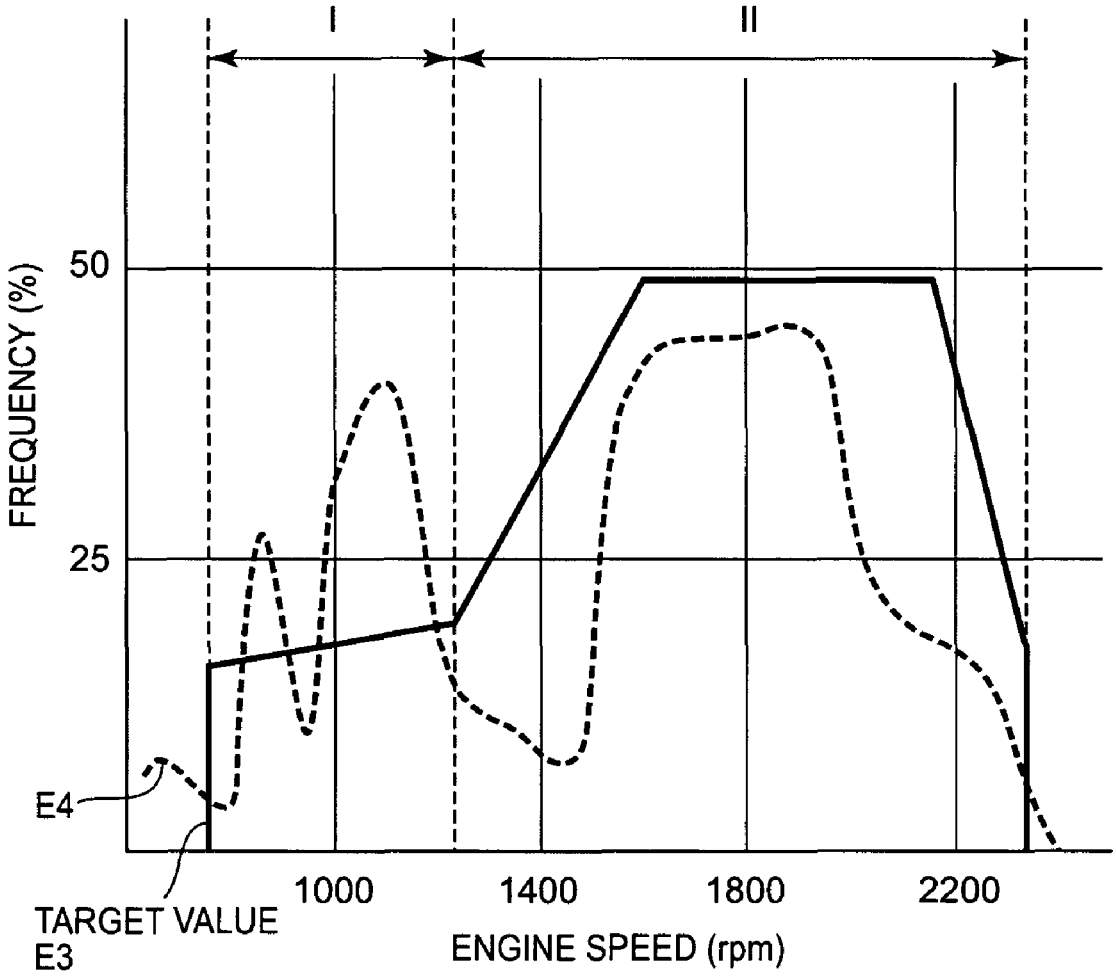
FIG. 6 is a diagram showing the engine speed distribution per unit time.

Next, a control example in which the state value is the engine speed will be described. FIG. 6 is a graph of the engine speed distribution per unit time.

As shown in FIG. 6, the control section 35 sets region I and region II in the possible range of variation of the engine speed. Region I is a region in which it is inferred that the engine is in an automatic deceleration state or an idling state. Region II is a region which is suitable for the operation of the construction machine.

The setting section 36 sets a different target value E3 for both of the regions I and II, in accordance with instructions from the user, and these target values E3 are stored in the control section 35. The engine speed is detected within a prescribed time period by means of the engine speed detector 31, and the frequency distribution E4 of the engine speed thus detected is calculated by the control section 35 and stored in the control section 35. The control section 35 compares the previously determined target value E3 with the detected and calculated engine speed frequency distribution E4, and if the frequency distribution E4 exceeds the target value E3, then the construction machine is judged to be operating inefficiently and a message is displayed on the monitor screen 26 prompting the operator to control the machine in such a manner that the frequency distribution E4 comes within the target value E3. Furthermore, the message displayed is specified by the setting section 36, and different message contents are previously prepared in the control section 35 for each region.

Figure 7:
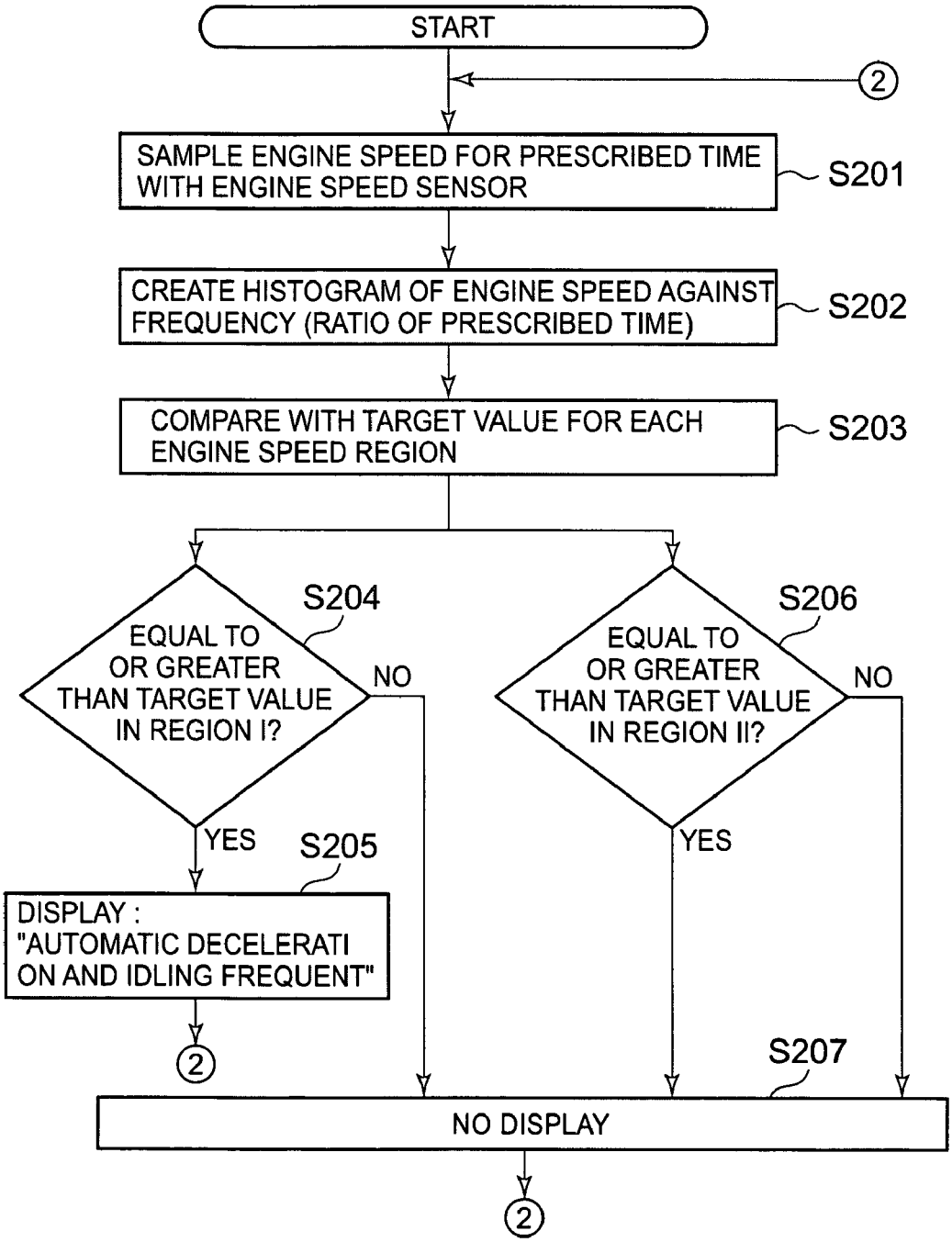
FIG. 7 is a flow diagram of a control example where the prescribed state value is the engine speed.

FIG. 7 shows a flowchart depicting the sequence of control for displaying a message in accordance with the result of comparing the frequency distribution E4 and the target value E3.

As shown in FIG. 7, the control section 35 samples the engine speed value detected by the engine speed detector 31, over a prescribed time period designated by the user (S201). The control section 35 creates a frequency distribution E4 of the engine speed on the basis of the sampled engine speed values (S202). Therefore, for each region of the engine speed preset by the setting section 36, the frequency distribution E4 is compared with the target value E3 preset by the setting section 36 (S203). Consequently, if the frequency distribution E4 exceeds the target value E3 in either of the engine speed regions I or II, then the construction machine is taken to be operating inefficiently, and the control section 35 displays a message containing operational advice which has been prepared previously for the engine speed region in question (S204-S206).

At step 204, the frequency of an automatic deceleration or idling state is judged by performing the aforementioned comparison with respect to region I. Similarly to FIG. 6, if the frequency distribution E4 has exceeded the target value E3, then this indicates that the operation of the machine is inefficient. Consequently, a preset message drawing attention to the inefficient operation of the machine is displayed (S205). On the other hand, if the frequency is equal to or less than the target value, then no message is displayed (S207). Automatic deceleration means control performed in order to automatically reduce the speed of the engine, when it is deduced that the engine is not performing any work while it is running, and when all of the operating levers, such as the travel levers 15 and 16, the work tool operating levers 19 and 20, and the like, are in a neutral state, then the engine speed is reduced instantly by a prescribed amount of revolutions (first deceleration). Furthermore, if a prescribed time period (for example, approximately four seconds) elapses, then the engine speed is reduced further by a prescribed number of revolutions (second deceleration). Thereafter, the engine speed is maintained (sustained) until a lever is operated. At step 206, the aforementioned comparison is carried out with respect to region II. In this region, even if the frequency distribution E4 exceeds the target value E3, no message is displayed (S207). This is because region II is a region which is suitable for the operation of the construction machine.

In FIG. 4 and FIG. 6 above, a judgment was made on the basis of the distribution of a single state value, but a composite judgment may be made on the basis of the frequency distributions of a plurality of state values.

Figure 8:
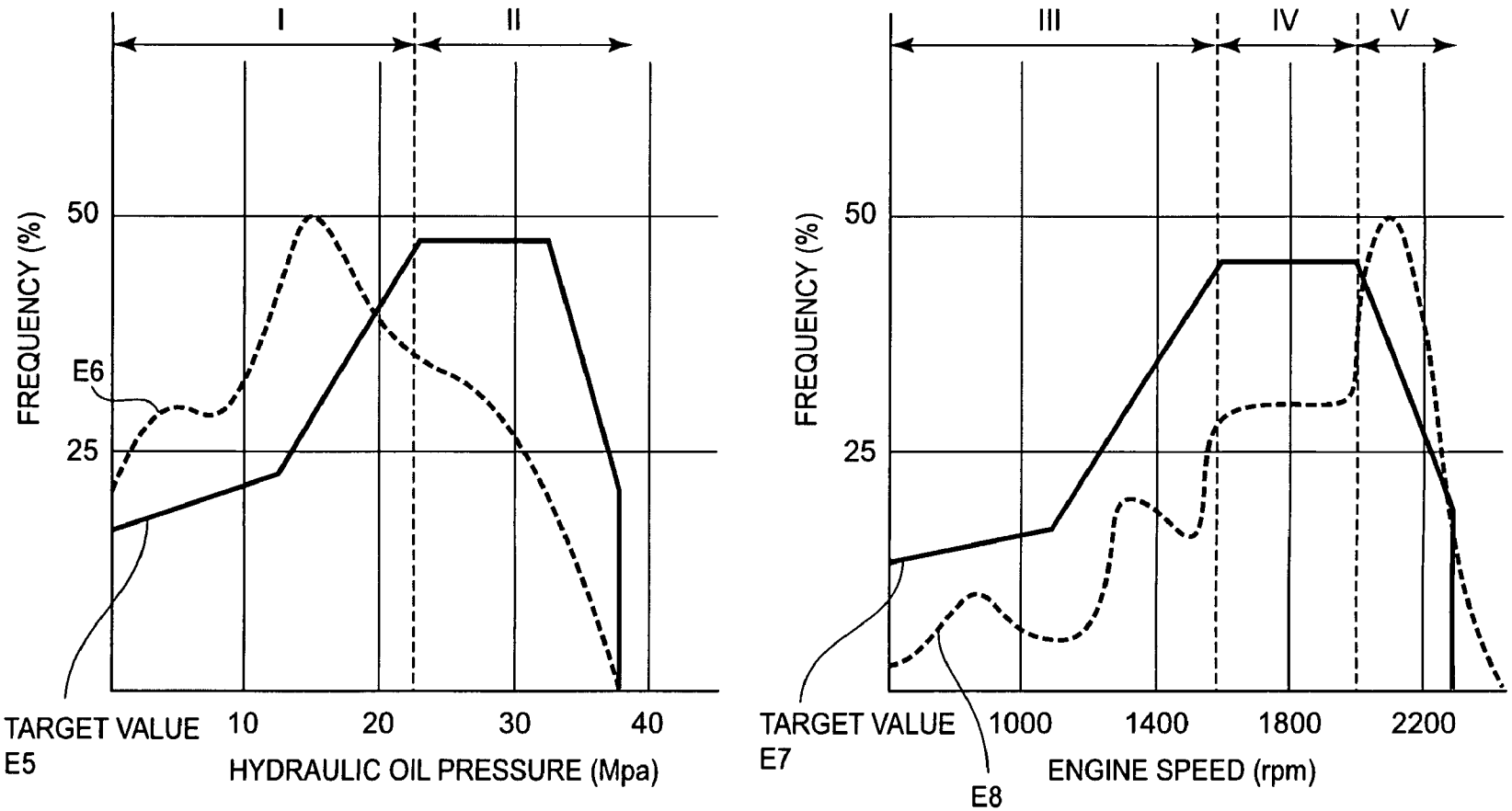
FIG. 8 is a diagram showing the composite state value distribution per unit time.

FIG. 8 shows a range of variation including both the state value distribution relating to the hydraulic oil pressure and the state value distribution relating to the engine speed.

As shown in FIG. 8, the control section 35 sets region I and region II within the range of variation of the hydraulic oil pressure, and it sets region I, region II and region III within the range of variation of the engine speed. The setting section 36 sets a different target value E5, respectively, for the hydraulic oil pressure regions I and II, in accordance with instructions from the user, and these target values E5 are stored in the control section 35. Similarly, the setting section 36 sets a different target value E7, respectively, for the engine speed regions I, II and III, in accordance with instructions from the user, and these target values E7 are stored in the control section 35. The hydraulic oil pressure is detected within a prescribed time period by means of the hydraulic oil pressure detector 32, and the frequency distribution E6 of the hydraulic oil pressure thus detected is calculated by the control section 35 and stored in the control section 35. Similarly, the engine speed is detected within a prescribed time period by means of the engine speed detector 31, and the frequency distribution E8 of the engine speed thus detected is calculated by the control section 35 and stored in the control section 35. Next, the control section 35 compares the target value E5 previously determined for the hydraulic oil pressure with the detected and calculated frequency distribution E6, for each region, and it stores the comparison result in the control section 35. Similarly, the control section 35 compares the target value E7 previously determined for the engine speed with the detected and calculated frequency distribution E8 of the engine speed, for each region, and it stores the comparison result in the control section 35. The control section sums the hydraulic oil pressure comparison result and the engine speed comparison result, and if it judges that the construction machine is operating inefficiently as a result of this sum, then it displays a message on the monitor screen 26 prompting the operator to control the machine in an efficient manner. Furthermore, the displayed message is preset by the setting section 36, and different message contents are previously stored in the control section 35 for each combination of the hydraulic oil pressure comparison result and the engine speed comparison result.

Figure 9:
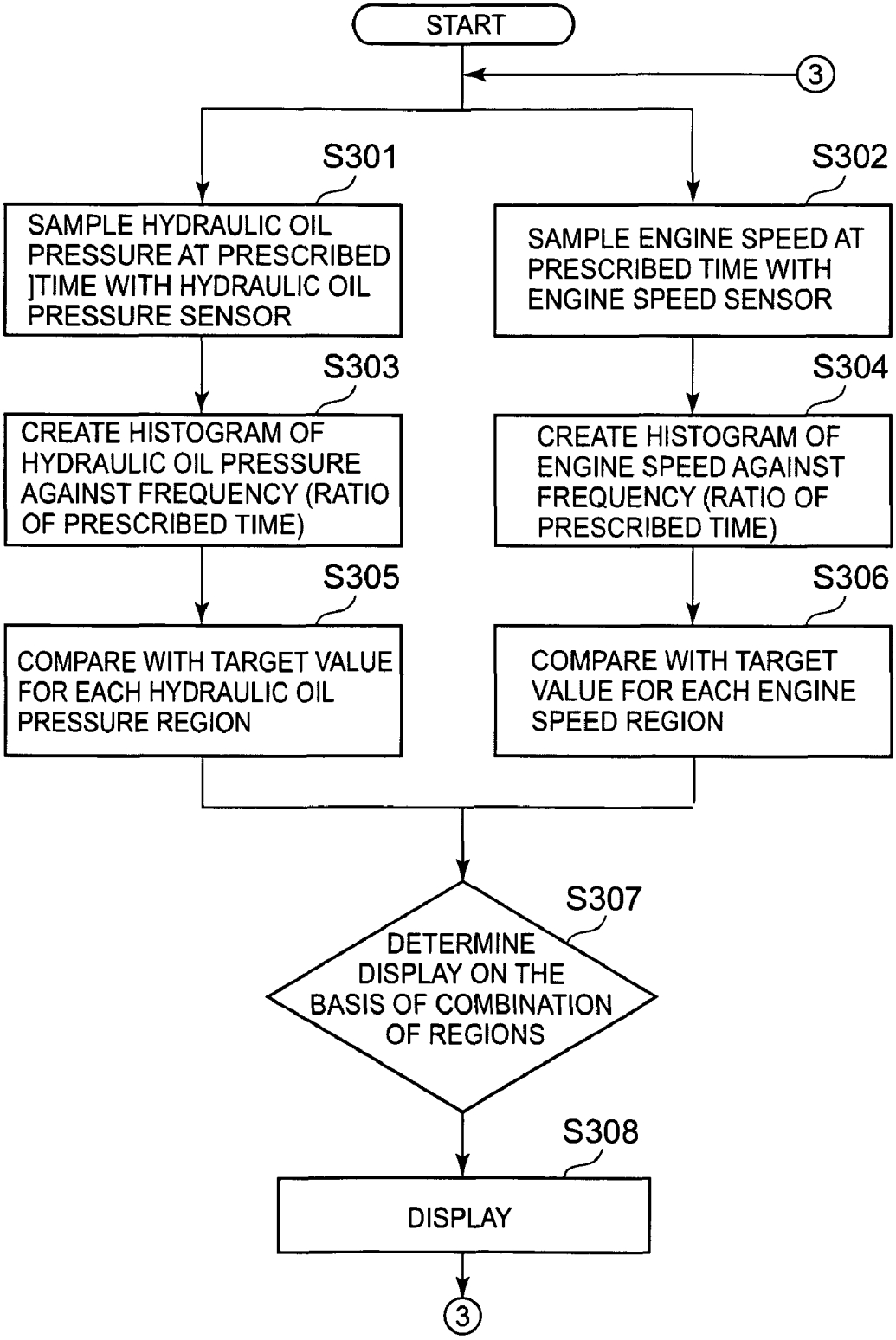
FIG. 9 is a flow diagram of a control example where a plurality of state values are used.

FIG. 9 shows a flowchart illustrating the work flow of control for summing the result of a comparison between the frequency distribution E6 of the hydraulic oil pressure and the target value E5 of the hydraulic oil pressure, and the result of a comparison between the frequency distribution E8 of the engine speed and the target value E7 of the engine speed, and displaying a message according to the combination of comparison results.

As shown in FIG. 9, the control section 35 samples the hydraulic oil pressure detected by the hydraulic oil pressure detector 32, over a prescribed time period designated by the user (S301). Furthermore, the control section 35 also samples the engine speed detected by the engine speed detector 31, over a prescribed time period designated by the user (S302). Next, the control section 35 creates a frequency distribution E6 for the hydraulic oil pressure on the basis of the sampled hydraulic oil pressure (S303). Furthermore, the control section 35 also creates an engine speed distribution E8 on the basis of the sample engine speed (S304). For each hydraulic oil pressure region, the frequency distribution E6 is compared with the target value E5 preset by the user, and a comparison result is stored in the control section 35 (S305). For each engine speed region, the frequency distribution E8 is compared with the target value E7 preset by the user, and a comparison result is stored in the control section 35 (S306). If the frequency distribution exceeds the target value in either of the variation ranges, then the control section judges that the construction machine is operating inefficiently. Next, the control section 35 sums the comparison result for the hydraulic oil pressure with the comparison result for the engine speed (S307) and for each different combination of results, it displays a different operational advice message which has been stored previously (S308).

FIG. 10 is a display example of the different messages for different result combinations which are displayed when the respective comparison results are summed, in a case where there is a plurality of prescribed state values, relating respectively to the hydraulic oil pressure and the engine speed. By means of the aforementioned comparison in the hydraulic oil pressure region, if the frequency distribution E6 exceeds the target value E5, and if the frequency distribution E8 exceeds the target value E7 on the basis of the aforementioned comparison in engine speed region III, then it is inferred that light-load operation is frequent and wasteful operation is frequent. Therefore, the construction machine is taken to be operating inefficiently, and a previously determined message warning about the inefficient operation of the construction machine, or a message recommending the operator to work the construction machine in an energy-saving mode, or the like, is displayed (T101). If the frequency distribution E6 exceeds the target value E5 as a result of the aforementioned comparison in hydraulic oil pressure region I, and the frequency distribution E8 exceeds the target value E7 as a result of the aforementioned comparison in engine speed region IV, then it is inferred that the construction machine is performing suitable work. Therefore, a previously determined message praising this suitable operation is displayed (T103). Similarly, if the frequency distribution E6 exceeds the target value E5 as a result of the aforementioned comparison in hydraulic oil pressure region I, and the frequency distribution E8 exceeds the target value E7 as a result of the aforementioned comparison in engine speed region V, then it is inferred that the engine speed is high and the work load is light, and hence the construction machine is operating inefficiently. Therefore, a previously determined message warning about the inefficient operation is displayed (T105). If the frequency distribution E6 exceeds the target value E5 as a result of the aforementioned comparison in hydraulic oil pressure region II, and the frequency distribution E8 exceeds the target value E7 as a result of the aforementioned comparison in engine speed region III, then it is inferred that the load is high and that the construction machine is performing wasteful work frequently. Therefore, it is judged that the construction machine is operating inefficiently, and a previously determined message warning about this inefficient operation is displayed (T107). If the frequency distribution E6 exceeds the target value E5 as a result of the aforementioned comparison in hydraulic oil pressure region II, and the frequency distribution E8 exceeds the target value E7 as a result of the aforementioned comparison in engine speed region V, then it is inferred that the load is high and that the construction machine is working frequently at high engine speed. Therefore, it is judged that the construction machine is operating inefficiently, and a previously determined message warning about this inefficient operation is displayed (T111).

If the frequency distribution E6 of the detected hydraulic oil pressure exceeds the target value E5, as in table 102, table 104, table 106, table 108, table 109, table 110 and table 112 shown in FIG. 10, but the frequency distribution E8 of the engine speed is equal to or less then the target value E7, then it is inferred that the construction machine is operating efficiently, and no particular warning is presented to the operator and no message is displayed.

With regard to the single state value which relates to the operational condition of the construction machine, besides the hydraulic oil pressure or engine speed described above, it is also possible to judge the frequency of an automatic deceleration state and the frequency of a lever lock state.

Figure 11:
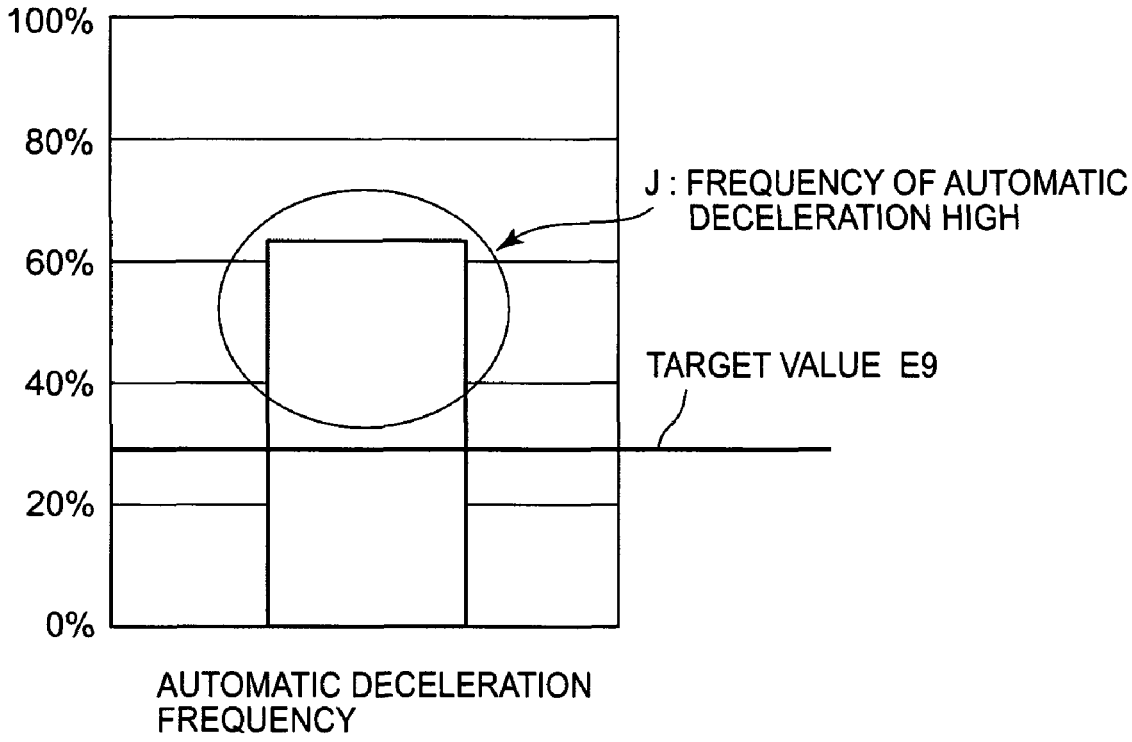
FIG. 11 is a diagram showing the frequency of an automatically decelerated state.

FIG. 11 is a diagram showing a judgment of the frequency of an automatic deceleration state. The setting section 36 sets the target value E9 for the automatic deceleration frequency and this target value E9 is stored in the control section 35. The frequency of the automatic deceleration state is detected by the control section, and the detected frequency of the automatic deceleration state is compared with the previously determined target value E9. If the frequency of the automatic deceleration state exceeds the target value E9 as a result of this comparison, then it is judged that the construction machine is operating inefficiently, and a message is displayed on the monitor screen 26 prompting the operator to control the machine in such a manner that the frequency of the automatic deceleration state comes within the target value E9. The displayed message is preset by the setting section 36 and is stored in the control section 35.

Figure 12:
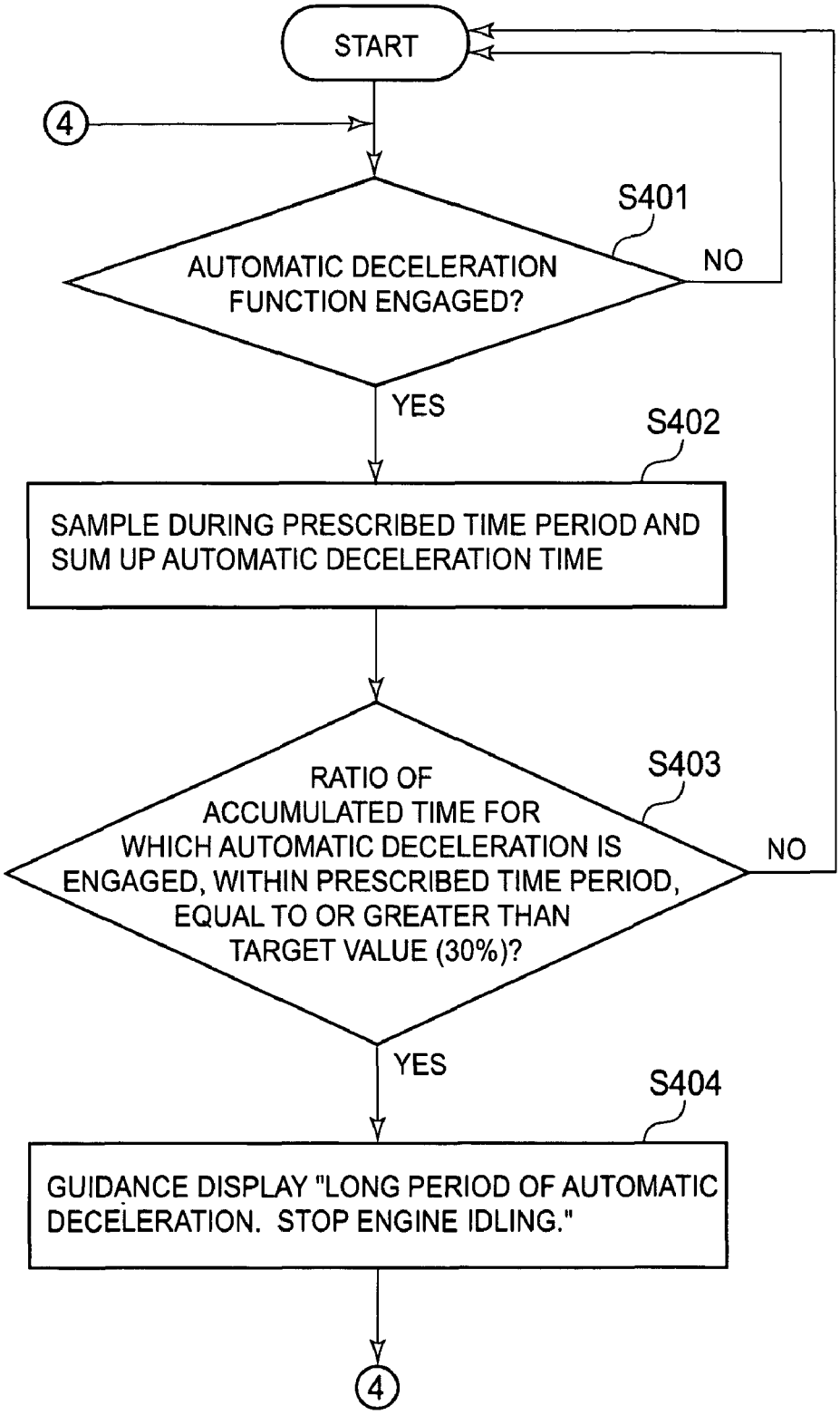
FIG. 12 is a flow diagram of a control example where an automatic deceleration state is used.

FIG. 12 shows a flowchart depicting the sequence of control for displaying a message in accordance with the result of comparing the frequency distribution of the automatic deceleration state and the target value E9.

As shown in FIG. 12, the control section judges that the construction machine is in an automatic deceleration state (S401). If the construction machine is not in an automatic deceleration state, the procedure returns to the start and this detection is repeated. At step 402, the time during which the automatic deceleration state is detected within a prescribed time period is added up, and the frequency of the automatic deceleration state is calculated (S403). Thereupon, if the ratio of the automatic deceleration state in the prescribed time period is equal to or greater than the target value E9 (30%), as shown in FIG. 11, then it is inferred that an idle state has continued for a long period of time, and hence it is judged that the construction machine is operating inefficiently. Therefore, a previously determined message is displayed to the operator in such a manner that the frequency of the automatic deceleration state comes within the target value E9 (S404).

Figure 13:
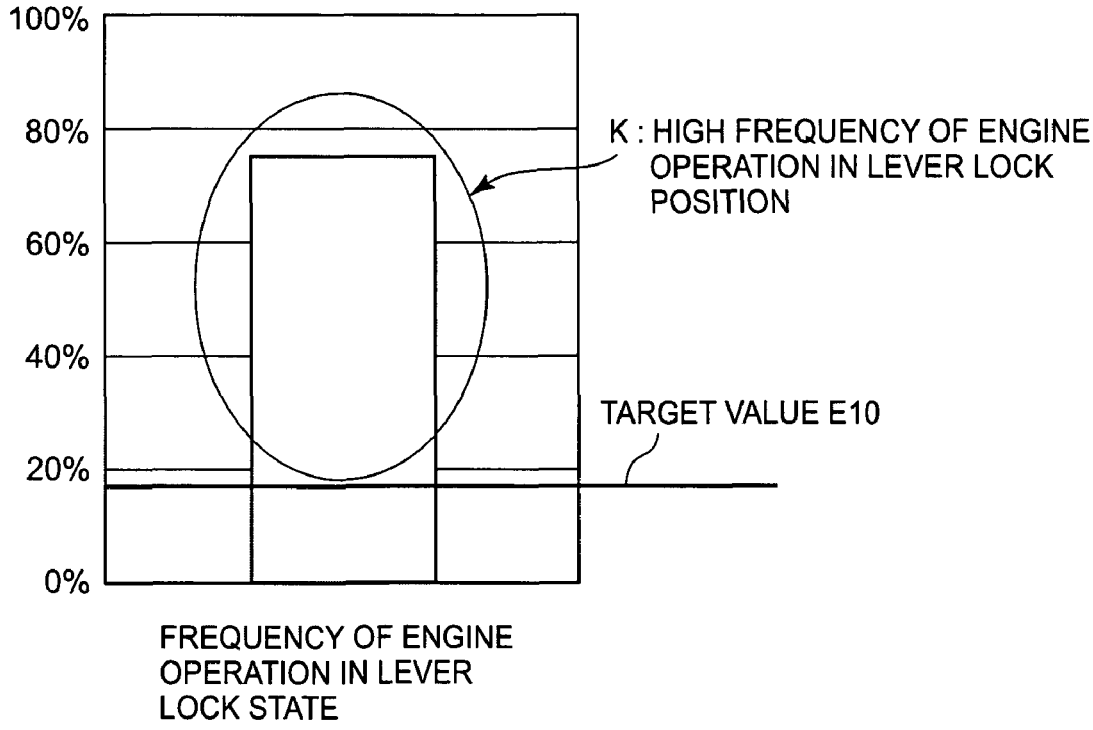
FIG. 13 is a diagram showing the engine speed frequency in a lever lock state.

FIG. 13 is a diagram showing a judgment of the frequency of a lever lock state. The setting section 36 sets the target value E10 for the lever lock frequency and this target value E10 is stored in the control section 35. The frequency of the lever lock state is detected by the control section, and the detected frequency of the lever lock state is compared with the previously determined target value E10. If the frequency of the lever lock state exceeds the target value E10 as a result of this comparison, then it is judged that the construction machine is operating inefficiently, and a message is displayed on the monitor screen 26 prompting the operator to control the machine in such a manner that the frequency of the lever lock state comes within the target value E10. The displayed message is preset by the setting section 36 and is stored in the control section 35.

Figure 14:
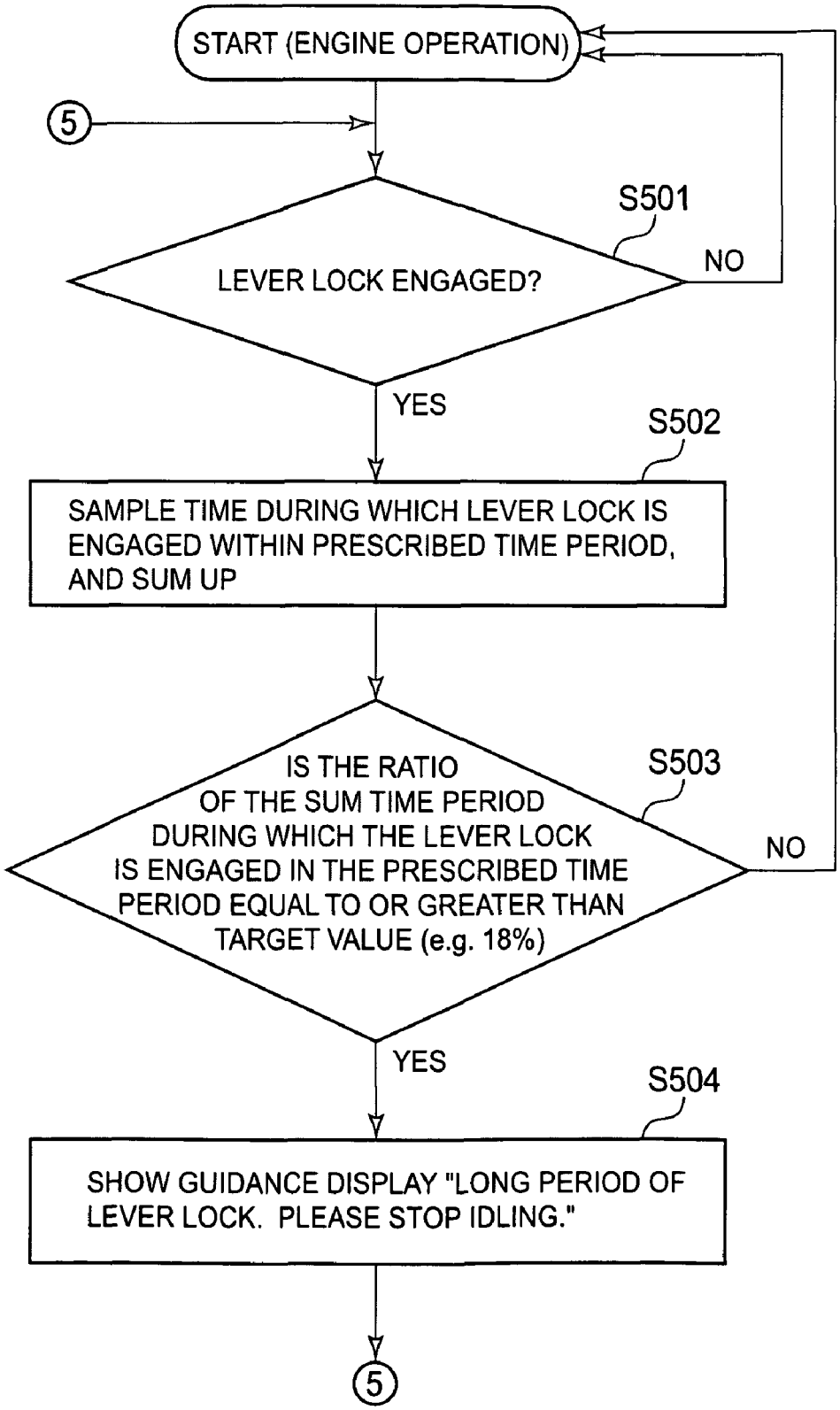
FIG. 14 is a flow diagram of a control example where a lever lock state is used.

As shown in FIG. 14, the control section judges whether the construction machine is in a lever lock state (S501). If the construction machine is not in a lever lock state, the procedure returns to the start and this detection is repeated. At step 502, the time during which the lever lock state is detected within a prescribed time period is added up, and the frequency of the lever lock state is calculated (S503). Thereupon, if the ratio of the lever lock state in the prescribed time period is equal to or greater than the target value E10 (18%), as shown in FIG. 14, then it is inferred that an idle state has continued for a long period of time, and hence it is judged that the construction machine is operating inefficiently. Therefore, a previously determined message is displayed to the operator in such a manner that the frequency of the lever lock state comes within the target value E10 (S504).

The target value E9 (30%) in FIG. 11 and the target value E10 (18%) in FIG. 13 can be set by using the setting section 36, or the user can set the target value freely.

Figure 15:
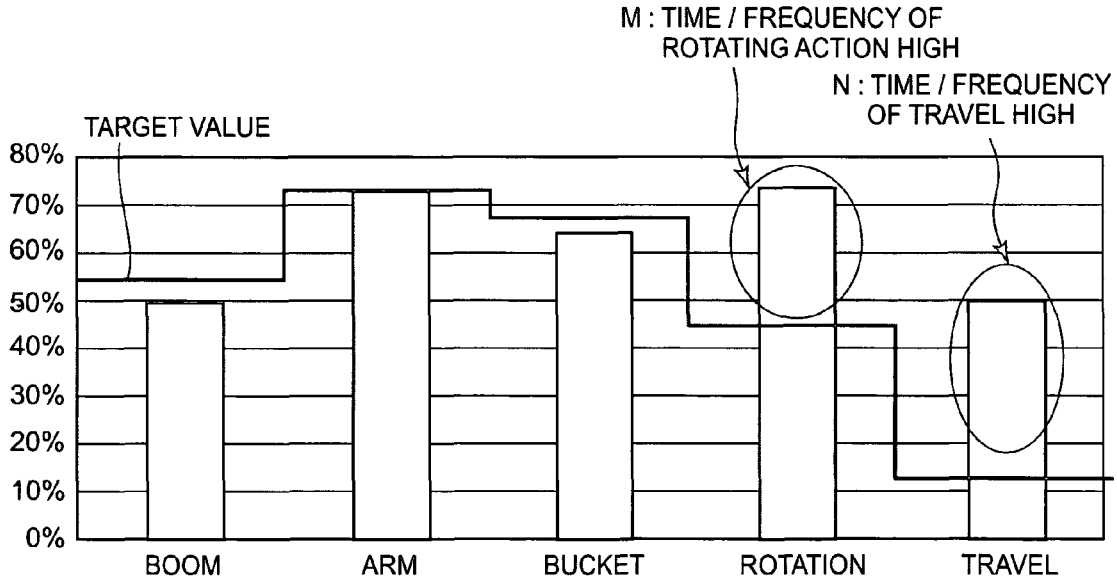
FIG. 15 is a diagram showing the frequency of a work action.

Moreover, as shown in FIG. 15, it is also possible to make judgments on the basis of the frequency of operations, such as a swinging operation of the boom 5, a swinging operation of the arm 6, a swinging operation of the bucket 7, a rotating operation of the upper rotating body 3, a traveling operation, and the like. More specifically, a target value (target setting) is preset for each operation and this preset value is compared with the actual distribution of the operation. In FIG. 15, the range M is a range where the rotational frequency is high and exceeds the target value (target setting). Therefore, a message indicating, for example, "reduce fuel consumption by reducing angle of rotation", or the like, is displayed on the monitor screen 26. Furthermore, the range N is a range where the travel time frequency is high and exceeds the target value (target setting). Consequently, a message is displayed on the monitor screen 26 indicating, for example, "High frequency of travel. Avoid unnecessary movement in the work site. Try to operate the machine efficiently." or "High frequency of travel. Reduce fuel consumption by lowering engine speed by about 200 rpm.", or the like. In this case, of course, if the operating frequency exceeds the preset value for the boom 5, arm 6, bucket 7, or the like, then advice for reducing the frequency thereof is displayed. The frequency of the boom 5, and the like, can be calculated on the basis of the extension and contraction of the piston rods of the respective cylinder mechanisms which cause the boom 5, or the like, to swing.

In the operating system for a construction machine described above, the frequency distribution of a prescribed state value relating to the operating condition of the construction machine within a prescribed time period is determined, this frequency distribution is compared with a target value at which the frequency of the prescribed state value indicates efficient operation, and if the frequency distribution lies outside the target values, then the construction machine is judged to be operating inefficiently and operational advice is provided to the operator in order to make the frequency distribution come within the target values. Therefore, if the current control of the construction machine is an inefficient operational state for that vehicle, then the operator is able to receive operational advice in order that he or she avoids inefficient operation and achieves efficient operation. Therefore, if the operator performs control in accordance with this advice, then he or she is able to perform efficient operation corresponding to the work contents.

In particular, if the frequency distribution of the prescribed state value is the hydraulic oil pressure distribution, then it is possible to detect a case where loadless operation has a high frequency, or conversely, a case where high-load operation has a high frequency, and the like. A case where the frequency of loadless operation is high corresponds to a long idling state, or the like, and therefore operational advice recommending the operator to halt idling, or to reduce the engine speed during idling, can be provided. In this way, reductions in fuel consumption, and the like, can be achieved. Furthermore, a case where the frequency of high-load work is high corresponds to a case where excessive load is applied frequently, and therefore operational advice recommending the operator to avoid work of this kind can be presented and hence highly efficient work can be performed. Furthermore, if the prescribed state value is the frequency distribution of the engine speed, then it is possible to detect a low-speed idling state where the engine speed is reduced, or a case where the automatic deceleration state, and the like, has high frequency, and the like. Therefore, if a low-speed idling state of reduced engine speed of this kind, or the like, occurs frequently, then it is possible to provide operational advice in order that the operator halts idling. Therefore, fuel consumption can be improved, for instance. Moreover, if the prescribed state value is the frequency distribution of a work action, then if the construction machine is an excavator, for example, it is possible to detect a boom swinging operation, an arm swinging operation, a bucket swinging operation, a rotating operation of the upper rotating body, a travel operation, and the like. Therefore, supposing that the rotation operation has high frequency, it is possible to provide operational advice in order that the operator reduces the angle of rotation of the machine. Furthermore, if the travel frequency is high (if the frequency of the travel time is high), then this indicates that wasteful movement in the worksite occurs frequently, and therefore operational advice can be provided recommending the operator to avoid unnecessary movement in the worksite.

Furthermore, in the operating system for a construction machine composed as described above, it is possible for the operator to see operational advice by looking at the monitor screen 26, while driving the construction machine or performing various work tasks, and therefore the operator can immediately make an effort to operate and control the machine in a way which seeks to improve fuel consumption, during travel or during work (for example, when using the construction machine to perform an excavation task, or the like). Consequently, the operator can make a contribution toward saving energy.

Figure 16:
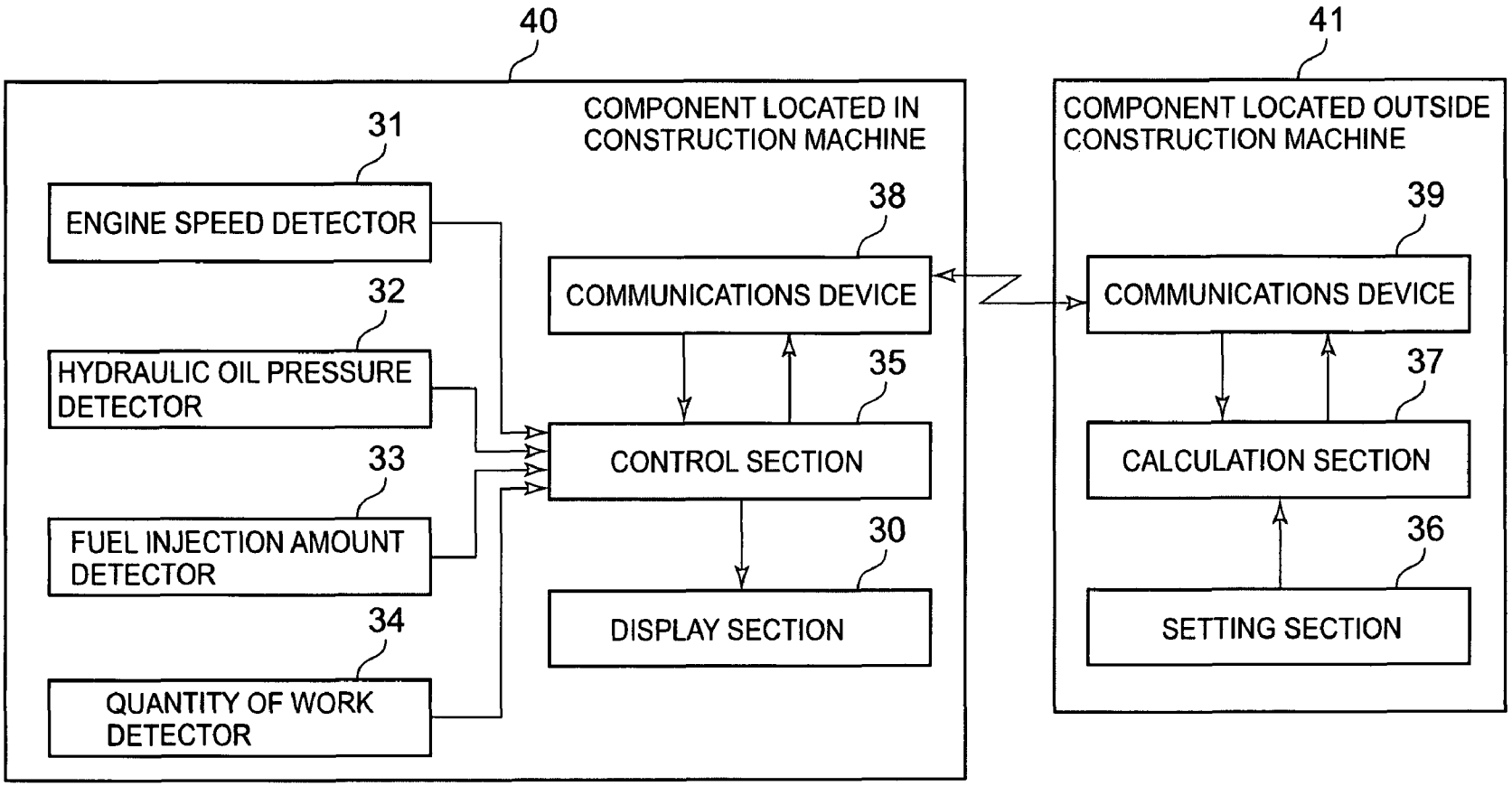
FIG. 16 is a simplified block diagram showing a further embodiment of an operating system according to the present invention.

In the embodiment described above, the whole operating system is mounted in the construction machine, but as shown in FIG. 16, it is also possible to compose the operating system by means of a component 40 located in the construction machine, and another component 41 located outside the construction machine. In this case, the component 40 located in the construction machine comprises an engine speed detector 31, a hydraulic oil pressure detector 32, a fuel injection amount detector 33, a quantity of work detector 34, control section 35, display section 30, a communications device 38, and the like. Furthermore, the component 41 located outside the construction machine comprises setting section 36, calculating section (control section) 37, a communications device 39, and the like.

More specifically, data for the prescribed state value is detected by the engine speed detector 31, hydraulic oil pressure detector 32, or the like, and this data is gathered by the control section 35 and sent by the communications device 38 to the component 41 located outside the construction machine. In the component 41, this data is sent from the communications device 39 to the calculation section 37. The target value preset by the setting section 36 is input to the calculation section 37, and in this calculation section 37, the actual distribution is compared with the target value, and if the aforementioned frequency distribution lies outside the target values, then it is judged that the construction machine is operating inefficiently. Operational advice recommending that the frequency distribution be brought within the target values is sent from the communications device 39 to the machine-side communications device 38, in such a manner that the advice can be displayed on the display section 30 via the control section 35. In this case, in the calculation section 37, it is judged whether the respective prescribed state values indicate inefficient operation or efficient operation, and this judgment result is transmitted from the communications device 39 to the communications device 38. The machine-side control section 35 decides the display contents on the basis of this judgment, in such a manner that the display contents thus decided are displayed.

By constituting an operating system by means of a component 40 located in the construction machine and a component 41 located outside the construction machine, in this way, it is possible to reduce the amount of equipment constituting the system that is mounted in the construction machine, and hence the weight and size of the construction machine can be reduced. Moreover, since operational advice is sent to the construction machine from a section outside the construction machine, it is possible to set the timing at which this operational advice is sent to the construction machine, to a desirable timing, and the contents of the information thus transmitted can be changed as desired. Furthermore, it is possible for advice which is matched to the work being performed by the operator in the operator's cab 11, and the like, to be conveyed to the operator at a suitable timing, and therefore the operator can readily devise a highly efficient working method. If, on the other hand, the whole operating system is mounted in the construction machine, then the amount of equipment installed in the construction machine increases, but since the processing for creating operational advice can be performed swiftly, it is possible to avoid an inefficient operational state straight away and hence stable and highly efficient work can be performed.

Furthermore, in the case of both the composition shown in FIG. 3 and the composition shown in FIG. 16, display section 30 may be provided externally to the machine. In this case, machine-side display section 30 may also be provided, as described previously, or the machine-side display section 30 may be omitted. If display section 30 is provided outside the construction machine, then an externally located work manager, or the like, is able to identify the operational advice. Therefore, the work manager, or the like, is able to ascertain whether the construction machine is operating inefficiently or efficiently, thereby facilitating his or her subsequent management duties, and so on.

Moreover, as a further embodiment, it is also possible to provide a sound generator (not illustrated) in the operator's cab 11, in such a manner that the aforementioned advice can be conveyed to the operator in the operator's cab 11 by means of a voice announcement issued from the sound generator. More specifically, the advice is generated by means of a voice which can be heard by the operator inside the operator's cab 11. The voice announcement from the sound generator may be provided independently, or it may be used in conjunction with the monitor display described above. In the case of a voice announcement, the operator is able to ascertain the aforementioned advice while looking forwards from the front window 23, or the like, thereby preventing the operator from being distracted from the task of operating and controlling the machine. However, in the case of a voice announcement, the advice may be difficult to hear due to the noise in the work site, or the like, and in a case of this kind, advice can be conveyed to the operator by means of the aforementioned monitor display. Therefore, by combining use of a voice announcement and a monitor display, it is possible to convey advice to the operator in a reliable fashion.

Furthermore, it is also possible to display the fuel consumption per unit time, or the fuel consumption per quantity of work, as a prescribed state value relating to the operational state of the construction machine. More specifically, the frequency distribution of the prescribed state value is taken to be the fuel consumption amount or the rate of fuel consumption, and by providing operational advice to the operator, or the like, in order to avoid inefficient operation, in the case of inefficient operation where the fuel consumption amount or the fuel consumption rate is greater than a target value, then it is possible for the operator immediately to operate the machine in such a manner that the fuel consumption amount or the fuel consumption rate assumes the target value. Therefore, efficient operation can be performed.

According to the embodiment described above, it is possible to detect a case where loadless operation has a high frequency, or conversely, a case where high-load operation has a high frequency, and the like. A case where the frequency of loadless operation is high corresponds to a long idling state, or the like, and therefore a message recommending the operator to halt idling, or to reduce the engine speed during idling, can be provided. In this way, reductions in fuel consumption, and the like, can be achieved. Furthermore, a case where the frequency of high-load work is high corresponds to a case where excessive load is applied frequently, and therefore a message recommending the operator to avoid work of this kind can be provided and hence highly efficient work can be performed. Furthermore, it is also possible to detect a low-speed idling state where the engine speed is reduced, or a case where the automatic deceleration state, and the like, has high frequency, and the like. Therefore, if a low-speed idling state of reduced engine speed of this kind, or the like, occurs frequently, then it is possible to output a message in order that the operator halts idling. Therefore, fuel consumption can be improved, for instance.

According to the embodiment described above, if the construction machine is an excavator, for example, then it is possible to detect a boom swinging operation, an arm swinging operation, a bucket swinging operation, a rotating operation of the upper rotating body, a travel operation, and the like. Therefore, supposing that the rotating operation has high frequency, it is possible to output a message in order that the operator reduces the angle of rotation of the machine. Furthermore, if the travel frequency is high (if the frequency of the travel time is high), then this indicates that wasteful movement in the worksite occurs frequently, and therefore a message can be output, recommending the operator to avoid unnecessary movement in the worksite. Consequently, highly efficient work can be performed.

Furthermore, in the case of inefficient operation where the fuel consumption amount or the fuel consumption rate is greater than a target value, it is possible for the operator, or the like, to receive a message in order that he or she avoids operation of this kind. Thereby, it is possible for the operator immediately to operate the machine in such a manner that the fuel consumption amount or the fuel consumption rate assumes a target value, and hence efficient operation can be performed.

According to the embodiment described above, by using sound output section, an operator located in the operator's cab 11 is able readily to identify a message by hearing, as well as being able to identify a message by means of a monitor screen.

According to the embodiment described above, it is possible to determine the frequency distribution of a prescribed state value and rapidly carry out processing for providing a message on the basis of a comparison between that frequency and the target value. Therefore, an inefficient operating state can be avoided straight away, and stable and highly efficient work can be performed.

Furthermore, the amount of equipment constituting the operational control system that is mounted in the construction machine can be reduced and therefore the size of the construction machine can be reduced. Since a message is sent to the construction machine from a section outside the construction machine, it is possible to set the timing at which this message is sent to the construction machine, to a desirable timing, and the contents of the information thus transmitted can be changed as desired. Furthermore, it is possible for a message which is matched to the work being performed by the operator in the operator's cab, or the like, to be conveyed to the operator at a suitable timing, and hence the operator can readily devise a highly efficient working method.

According to the embodiment described above, an externally located work manager, or the like, can identify this message, and the work manager, or the like, can ascertain whether the construction machine is being operated efficiently or inefficiently. This facilitates subsequent work management duties.

The invention was described above with respect to specific embodiments, but the invention is not limited to these embodiments and may also be implemented by incorporating various modifications, within the scope of this invention. For example, desirably, the position of the monitor screen 22 is a position where the monitor screen 26 can be viewed by the operator when he or she is sitting in the operator's cab 13 and driving the construction machine or performing a work task with the work tool 4. However, it is not limited to the position shown in FIG. 1. Moreover, the text of the operational advice shown on the monitor display is not limited to full sentences of the type indicated in the aforementioned embodiments, and short texts, such as "Improve fuel consumption", may be used. This is because, even if only the text "Fuel consumption", or the like, is displayed, this still allows the operator to judge that the current operation and control of the machine is inefficient, and he or she can therefore strive to operate and control the machine in a way which improves the fuel consumption. Furthermore, if operational advice is displayed on a monitor, then a text-only display may be provided, as in the aforementioned embodiment, but it is also possible to provide, simultaneously with this text, a diagram which makes the advice more readily understandable. Alternatively, the text may be omitted and only a diagram of this kind displayed. Furthermore, in the foregoing embodiments, advice is displayed on an existing monitor screen 22 which shows the engine status, and the like, but it is also possible to provide a separate advice display monitor device, which differs from the existing monitor device, in such a manner that advice can be displayed on this advice display monitor device. A graph diagram such as that in FIG. 4 may be displayed on the monitor screen 26, but in this case, the graph diagram may be removed when operational advice is shown on the monitor, or it may be displayed together with the operational advice. The construction machine is not limited to being an excavator, and the present invention may be applied to various types of machine, such as a crane, breaking machine, or the like.

The invention claimed is:

1. An operating system for a construction machine comprising:

a part configured for setting a target value with respect to a frequency distribution of a prescribed state value relating to an operational condition of the construction machine, said frequency distribution is a rate at which said prescribed state value occurs;

a part configured for detecting a prescribed state value; and a control part configured for calculating the frequency distribution of said prescribed state value detected by said part configured for detecting, comparing said frequency distribution thus calculated with said target value set by said part configured for setting, and outputting a previously prepared message in accordance with the comparison result, wherein a plurality of regions are set in a range of possible variation of said prescribed state value; said part configured for setting sets said target value for each of said regions; and said control part compares said frequency distribution with said target value, for each of said regions, and outputs said message in accordance with the comparison result for each of said regions.

2. The operating system for a construction machine according to claim 1, wherein said part configured for setting sets target values for a plurality of prescribed state values;

said part configured for detecting detects a plurality of prescribed state values; and said control part configured for calculating calculates a plurality of frequency distributions of said plurality of prescribed state values, compares said frequency distributions with said target values for said prescribed state values respectively, and outputs a previously prepared message in accordance with the combination of comparison results for said plurality of prescribed state values.

3. The operating system for a construction machine according to claim 1, wherein said prescribed state value is a hydraulic oil pressure.

4. The operating system for a construction machine according to claim 1, wherein said prescribed state value is an engine speed.

5. The operating system for a construction machine according to claim 1, wherein said prescribed state value is a frequency of a work action.

6. The operating system for a construction machine according to claim 1, wherein said prescribed state value is a fuel consumption amount or a fuel consumption rate.

7. The operating system for a construction machine according to claim 1, wherein said message is displayed on a monitor screen in an operator's cab.

8. The operating system for a construction machine according to claim 1, wherein said message is issued by means of a voice announcement from a voice generator.

9. The operating system for a construction machine according to claim 1, wherein the whole system is mounted in the construction machine.

10. The operating system for a construction machine according to claim 1, further comprising:

an component located in the construction machine and another component located outside the construction machine, wherein said message is sent from the component outside the construction machine to the component in the construction machine.

11. The operating system for a construction machine according to claim 1, wherein said message is displayed on a section located outside the construction machine.

12. An operating system for a construction machine comprising:

a part configured for setting a target value with respect to a frequency of a workless state of the construction machine, said frequency is a rate at which said workless state occurs;

a part configured for detecting a workless state during a period that an engine of said construction machine is operated; and a control part configured for calculating a frequency of said workless state detected by said part configured for detecting, comparing the frequency of said workless state thus calculated with said target value set by said part configured for setting, and outputting a previously prepared message in accordance with the comparison result, wherein said workless state is a state where an automatic deceleration function is engaged.

13. The operating system for a construction machine according to claim 12, wherein said workless state is a state where a lever lock function is engaged.

14. An operational control method comprising the steps of:

setting a target value with respect to a frequency distribution of a prescribed state value relating to an operational condition of a construction machine, said frequency distribution is a rate at which said prescribed state value occurs;

detecting a prescribed state value;

calculating the frequency distribution of said detected prescribed state value, comparing said calculated frequency distribution with said set target value, and outputting a previously prepared message in accordance with the comparison result, wherein a plurality of regions are set in a range of possible variation of said prescribed state value; said part configured for setting sets said target value for each of said regions; and said control part compares said frequency distribution with said target value, for each of said regions, and outputs said message in accordance with the comparison result for each of said regions.

15. An operating method for a construction machine comprising:

setting a target value with respect to a frequency of a workless state of the construction machine, said frequency is a rate at which said workless state occurs;

detecting a workless state during a period that an engine of said construction machine is operated; and calculating a frequency of said workless state detected by a detecting section, comparing the frequency of said workless state thus calculated with said target value set by a setting section, and outputting a previously prepared message in accordance with the comparison result, wherein said workless state is a state where an automatic deceleration function is engaged.

* * * * *